US005437507A

United States Patent [19]

Blumenkron

[11] Patent Number: 5,437,507

[45] Date of Patent: Aug. 1, 1995

[54] BAG WHICH IS MADE BY STITCHING OPAQUE FABRIC MATERIAL

[76] Inventor: Jorge L. Blumenkron, 12 Sur 2916, El Mirador, 72530 Puebla, Mexico

[21] Appl. No.: 90,776

[22] Filed: Jul. 13, 1993

[30] Foreign Application Priority Data

Jul. 14, 1992 [DE] Germany ..... 42 23 034.9

[51] Int. Cl.[6] ..... B65D 30/10; B65D 33/00

[52] U.S. Cl. ..... 383/107; 383/59

[58] Field of Search ..... 383/59, 108, 107

[56] References Cited

U.S. PATENT DOCUMENTS

| | | | |
|---|---|---|---|
| 2,399,973 | 5/1946 | Albin | 383/107 |
| 2,939,501 | 6/1960 | Cormon et al. | 383/107 |
| 4,194,652 | 3/1980 | Williamson et al. | 383/41 |
| 4,597,102 | 6/1986 | Nattrass | 383/107 |
| 4,646,357 | 2/1987 | Nattrass | 383/107 |
| 5,158,367 | 10/1992 | Derby | 383/107 |
| 5,165,802 | 11/1992 | Derby | 383/107 |
| 5,244,280 | 9/1993 | Porter et al. | 383/107 |

*Primary Examiner*—Stephen P. Garbe
*Attorney, Agent, or Firm*—Dvorak and Traub

[57] ABSTRACT

A bag comprising several side panels, a bottom panel and a top panel with a filling opening is made by stitching together opaque fabric webs forming the aforementioned panels. The bag includes seams which are formed by turning up edge regions of the fabric webs and in which at least one sealing strip of material is inserted and stitched to the fabric webs. To obtain increased sealing tightness of the stitching, the strips of material are of yielding construction and have an isotropic structure. The side panels of the bag may be constituted by a tubular one-piece fabric portion.

12 Claims, 3 Drawing Sheets

BAG WHICH IS MADE BY STITCHING OPAQUE FABRIC MATERIAL

TECHNICAL FIELD

The invention relates to a bag of the type which comprises side and bottom panels, a top panel which defines edges of a filling opening and at least one sealing strip wherein opaque fabric webs constituting said panels are stitched together at upturned edge regions by seams in which at least one said sealing strip is inserted which is stitched to said fabric webs.

BACKGROUND ART

In U.S. Pat. Nos. 4,307,764 and 4,822,179 folding so-called big bags, in particular for bulk materials are described. The bags generally have a square cross-section and the edges are stitched together to form seams. The seams are stitched by means of a single or double row of stitches. With these bags the seams are sealed to the required extent, so that powdered material essentially cannot escape from the bag in the region of the seams. This is particularly important if the transport and storage stresses caused by pushing, knocks, falls etc. exceed a certain level for the filled bags. Also the bag contents must be prevented from being contaminated by external influences and hazardous bag contents must be prevented from endangering the environment. This is achieved by providing the external material of the bags with a sealing coating or providing an innermost sealing sheet. In these cases, additional treatment of the bags to achieve sealing tightness of the seams results in a lengthy manufacturing process and an additional material requirement. Both of these factors increase the manufacturing costs.

In another attempt to seal such bags a textile fabric strip has been applied to the stitching or stitched into the seam fold. However, this does not achieve satisfactory sealing tightness at the seams, because the stitch holes of the seams which are produced during sewing expand when placed under a load. Bags of this kind are thus unsuitable particularly for powdered material. Moreover, the use of textile fabric strips as a sealing means, leads to increased expenditure in case of recycling of the bags which are no longer serviceable, due to the use of more than one type of material in the bag's construction.

OBJECTS OF THE INVENTION

An object of the invention is to provide an improved bag of the kind mentioned above which bag can be made cheaply with simple means and displays very high sealing tightness in the seam region in situations of long-term use and under high stress.

SUMMARY OF THE INVENTION

Thus, according to the invention there is provided a bag comprising side and bottom panels, a top panel which defines edges of a filling opening and at least one sealing strip of yielding material having an isotropic structure, whereby opaque fabric webs constituting said panels are stitched together at upturned edge regions by seams in which at least one said sealing strip is inserted which is stitched to said fabric webs.

Preferably the sealing strip of isotropic material has an unwoven structure such as a felt-like or fleece-like structure. Advantageously the sealing strip is many times thicker than the fabric webs used for manufacture of the bag panels. In particular, the sealing strip is preferably between 4 and 10 times thicker than the fabric webs. Preferably, the strips of material, the fabric webs and the thread used to stitch the seams are made of the same material, e.g. polypropylene.

A bag constructed according to the invention provides in an easy and surprising manner extremely high sealing tightness of the seams. Accordingly, no product can escape from the interior of the bag, even when it is placed under high mechanical load. Such loads can arise e.g. by pushing, knocks, falls, etc., in particular during transport of filled bags. Due to the very high sealing tightness of the seams, contamination of the product inside the bag by external influences is avoided, and it is also ensured that hazardous bag contents cannot pollute the environment. Furthermore, moisture is also prevented from entering the interior of the bag through the seams, so that the bag contents cannot be damaged by moisture. Moreover, it is very cheap and time-saving to obtain the sealed seams of the bag, because the yielding, isotropic sealing strip is inserted in the seams at the same time as stitching the bags. Corresponding subsequent treatment of the stitched bag is therefore eliminated. Furthermore, recycling of the bag material after the bag has become unusable is inexpensive. It is particularly advantageous that no bag contents can come into contact with the sealing strip, because it is inserted into the seam.

The invention is described by way of example in more detail below with reference to two embodiments of the invention.

DETAILED DESCRIPTION

Figure 1:
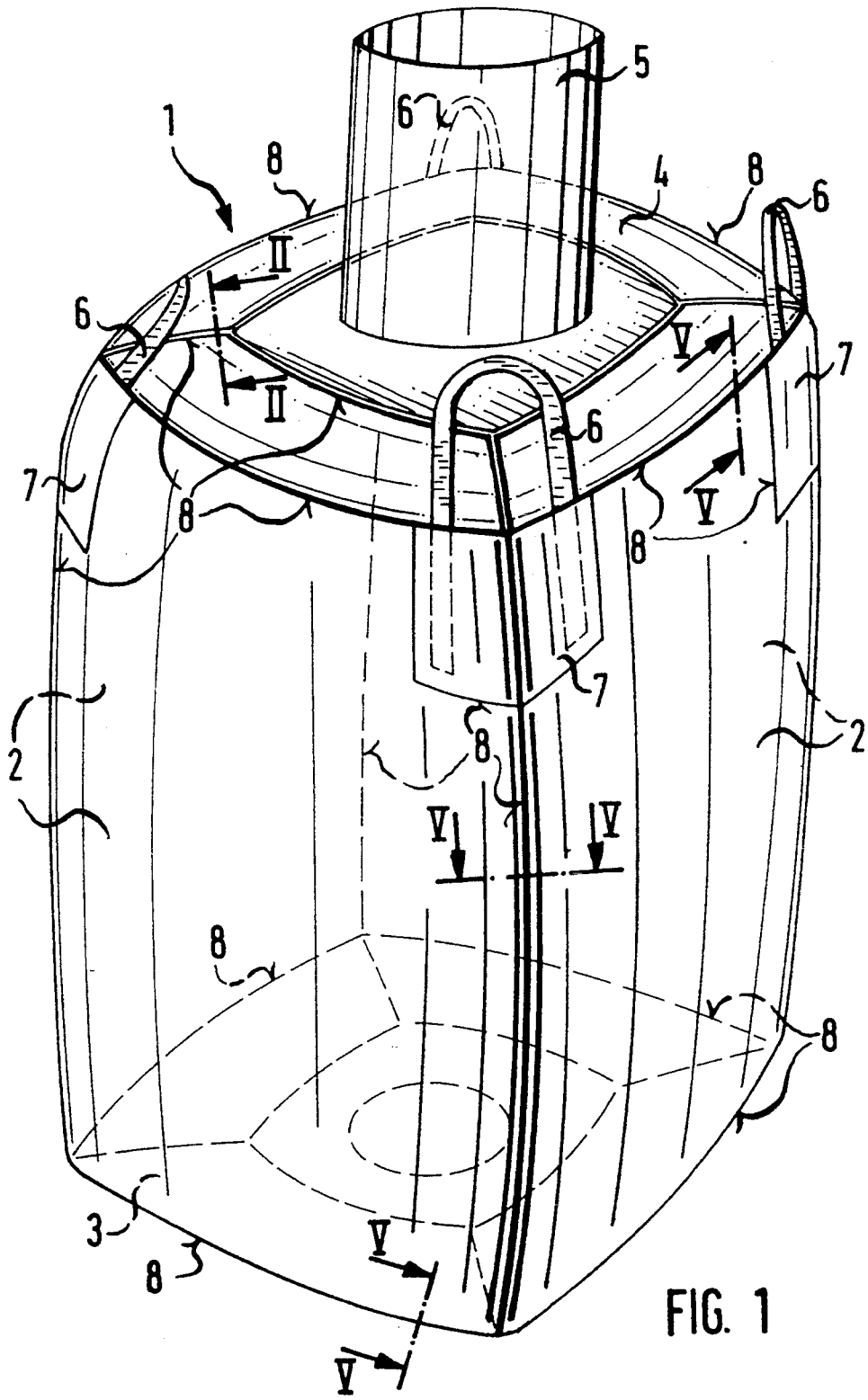
FIG. 1—a bag according to the invention in perspective view.

A folding bag according to the invention known in the art as a big bag is shown in FIG. 1. The bag includes four side panels 2, a bottom panel 3 and a top panel 4 with a collapsible and closable filling tube 5. Handles 6 together with outer reinforcing pieces 7 are stitched to the four corner regions of the bag, in order to facilitate movement of the filled bag by means of appropriate lifting devices. All the panels of the bag are made of known fabric material, such as polypropylene or another plastics material. The material is in the form of fabric webs cut to size. In order that no material can escape from the bag through the fabric material and/or that damaging and/or soiling material cannot enter the bag, the fabric material is provided with a sealing coating, e.g. by lamination with polypropylene by the hot spraying method.

All the fabric panels of the bag 1 as well as all other essential planar fabric portions of this bag are turned up at their edge regions and joined together there by means of sewing threads in a single or double row of stitches. By turning up the edge regions of the bag panels 2, 3 and 4 as well as those of other panel portions, seams 8 are produced as shown greatly enlarged, schematically and by way of example in FIGS. 2 and 5. Such seams may also be provided where the panels, e.g. 3 and 4, are composed of several portions and other fabric pieces, e.g. reinforcing pieces 7.

In the seams 8 are inserted sealing strips of yielding material, having an isotropic structure. As shown in FIGS. 2–5, a single strip of material is used in each case. A double strip can be used, depending on the intended use of the finished bag. The sealing strip or strips of material 9 are made of e.g. plastic fibres, preferably polypropylene, and have a felt-like or fleece-like structure. The width of the sealing strips depends on whether a single or double row of stitches is provided. The thickness of the sealing strips is many times thicker than that of the fabric webs selected for the panels of the bag; e.g. the thickness of the sealing strips is about 2 mm to 5 mm, preferably 3 mm to 5 mm, the thickness of the fabric webs for the panel material of the bag is about 0.5 mm. The isotropic material of the sealing strip 9 consists of closely intertwined, preferably hot-pressed fibres, and is compressible to a large extent even if the strip is subsequently machined. Such machining is carried out in the present case by the stitching process. The sealing strip displays a certain reserve of resiliency which proves to be advantageous, as described below.

Figure 2:
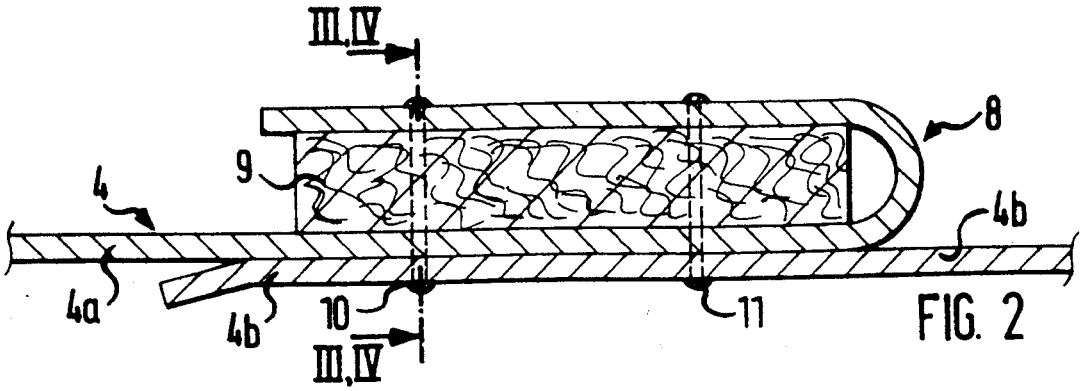
FIG. 2—a sectional view along the line II—II in FIG. 1.

FIG. 2 shows on a greatly enlarged scale a first embodiment of a seam according to the invention. The top panel 4 of the bag consists e.g. of the two panel portions 4*a* and 4*b*. In this case, only the panel portion 4*a* is turned up in its edge region to form a seam 8. A felt sealing strip 9 is located in the turned up region. All parts 4*a*, 4*b* and 9 are joined together by means of two parallel rows of stitches 10 and 11. The thread-like stitching material is preferably also made of polypropylene.

Figure 3:
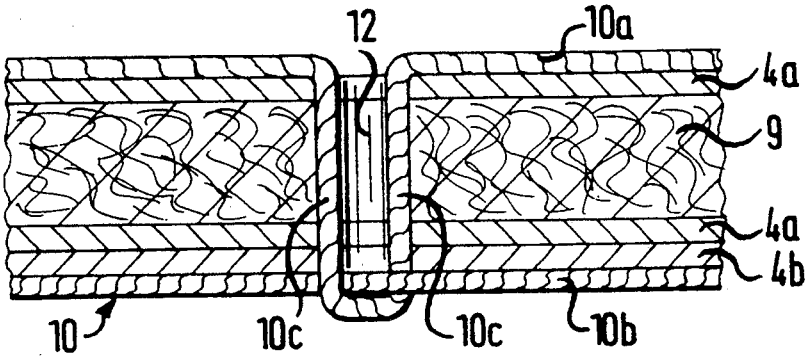
FIGS. 3 and 4—sectional views along the lines III—III and IV—IV in FIG. 2.
Figure 4:
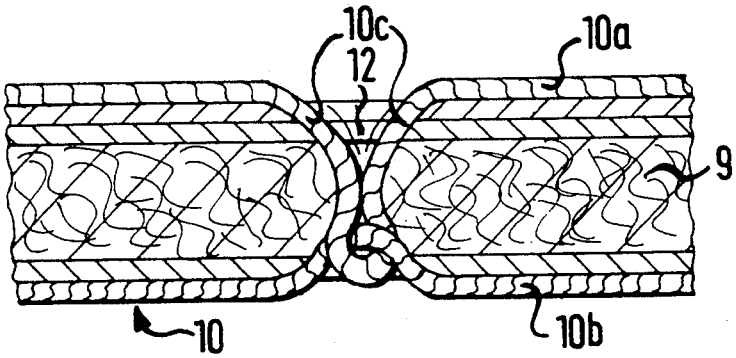

FIGS. 3 and 4 show, also greatly enlarged, a longitudinal section through the row of stiches 10 which is shown greatly simplified. FIG. 3 shows unloaded stitching and FIG. 4 shows loaded stitching. It can be seen that the stitching consists of two threads, namely an upper thread 10*a* and a lower thread 10*b*. The upper thread 10*a* extends through the stitch hole 12 and loops around the lower thread 10*b* in a known manner. Naturally, the stitching 10 in a known sewing technique may also consist of a single thread. For a better understanding of the ivnention, the sections 10*c* of the upper thread 10*a* extending through the hole 12 are shown spaced apart from each other; in practice, they are essentially in contact with each other after the stitching process.

In FIG. 4 it can be seen that the stitching 10 loaded by the bag contents causes a reduction in cross-section of the stitch hole 12. This is caused by the sealing strip of yielding material 9 which, on account of a certain reserve of resiliency in combination with its thickness, ensures encroachment of strip material in its central region into the interior of the hole when the two edge regions of the strip 9 are compressed by the sewing thread or threads at the edge of the hole. As a result, as tests have shown, when a load is placed on the stitching, the inner thread sections 10*c* are surprisingly pushed to the centre of the hole, which results in active closure of the stitch hole 10. Stitching 10, 11 produced in this way therefore leads to the result that the bag is absolutely sealed tight in the stitching regions even in case of high load during transport and handling due to falls, pushing, etc. This surprising sealing result is due to the isotropic nature of the material of the sealing strip 9. When load is placed on the bag and hence on the stitching no enlargement of holes occurs as is the case when a fabric material is used as the .sealing strip. The isotropic and yielding material of the strip 9 furthermore exerts mechanical damping on the stitch threads and bag panels when loaded. As a result the risk of destruction of the bag fabric at the stitching is at least reduced, if not even excluded.

Figure 5:
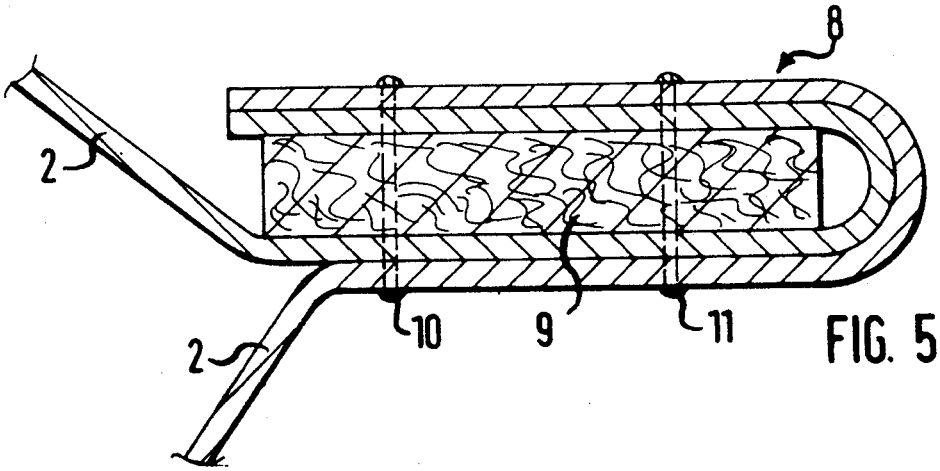
FIG. 5—a sectional view along the lines V—V in FIG. 1.

In FIG. 5 is shown a second embodiment of a seam 8, greatly enlarged. The essential difference between this seam and the seam 8 according to FIG. 2 lies in that the contacting edge regions of e.g. two bag panels 2 which meet, are turned up together to form a U-shaped seam. The strip of isotropic sealing material 9 is arranged between the arms of this double-layer U-shaped seam. The strip 9 is stitched to the seam edge of the bag panels 12, with the stitches 10 and 11, as described in conjunction with FIGS. 3 and 4. In this case also, the sealing effect caused by a load on the bag is as described in conjunction with FIGS. 2, 3 and 4.

In each of FIGS. 2 and 5 a seam is shown which comprises two rows of stitches 10 and 11. If the bag 1 concerned is intended for smaller loads, it may be sufficient to provide only one row of stitches.

Preferably the fabric material for the bag panels 2, 3 and 4, the sealing strip 9 in the seams 8 and the thread or threads for the seam stitches 10 and 11 are all of the same material. Polypropylene is particularly preferable.

In an advantageous development of the invention, the or each sewing thread for the seams 8 can be impregnated with oil. As the sewing threads themselves as a rule consist of a plurality of fibres, impregnation of the threads with oil has the effect that in the region of each stitch hole 12 a certain quantity of oil escapes from the thread and causes a sticky environment. Hence additional clogging of the stitch hole occurs, so as to further resist the passage of powdered material or other fine media through the stitch hole. In order to avoid contamination of the bag contents when the stitch threads contain or are impregnated with oil, it is advisable in the case of several rows of stitches to stitch only the outer row or the outer rows with oil-impreganated sewing threads. The innermost row of stitches is stitched with an oil-free sewing thread and thus oil cannot enter the interior of the bag. If an oil-impregnated sewing thread cannot endanger the bag contents, the single or innermost row of stitches may also consist of oil-impregnated stitch threads.

Figure 6:
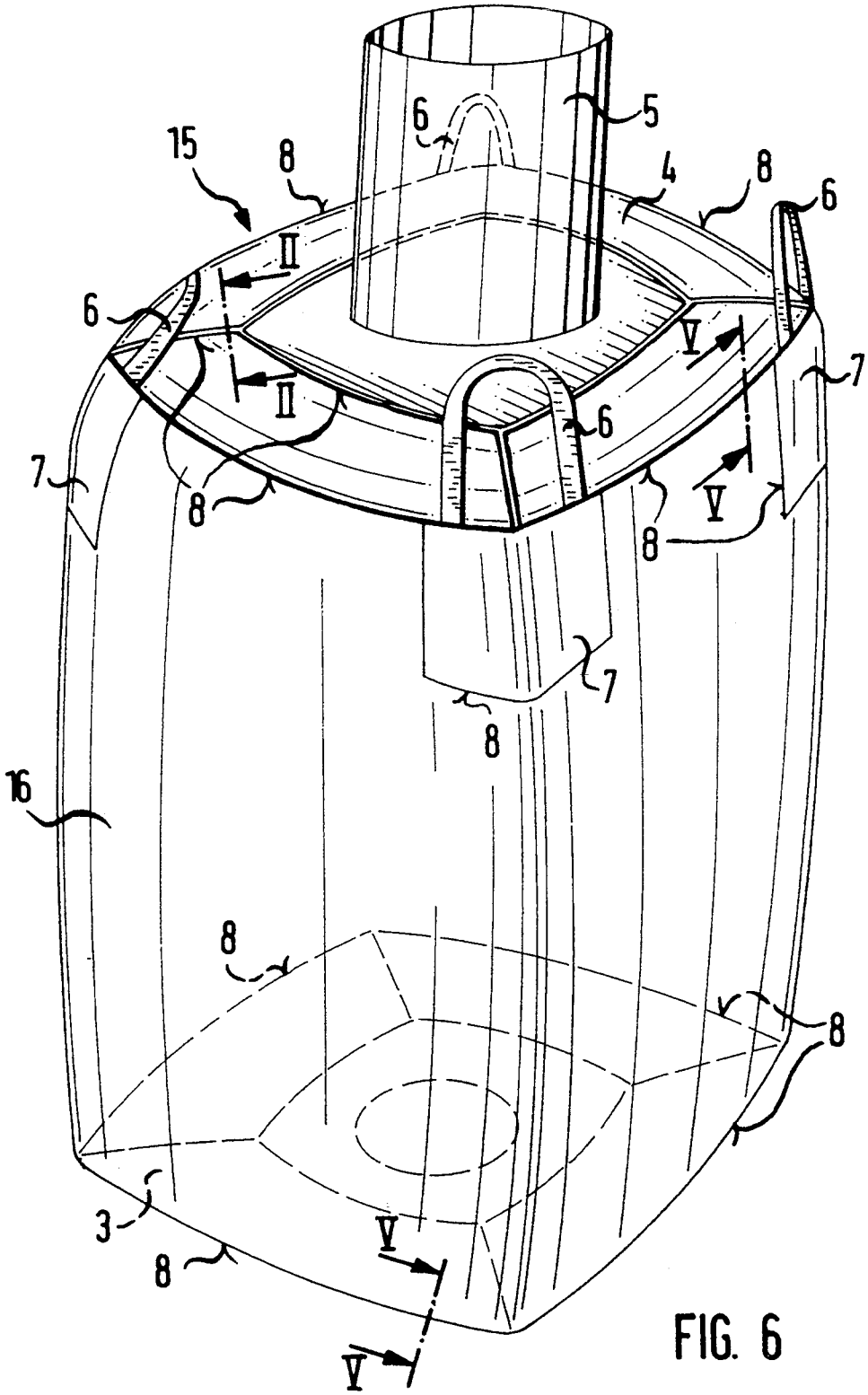
FIG. 6—a further embodiment of a bag according to the invention.

The bag 15 shown in FIG. 6, in which the same reference numbers are used, as far as there is conformity with the bag described above, differs from the one in FIG. 1 in that the side panels of the bag consist not of four separate fabric webs, but of a single tube portion 16 made of the fabric material described above. In such a case as FIG. 6 the bottom panel 3 and the top panel 4 can be made in one or more parts from fabric webs as described above. It is also possible to cut the tube portion 16 to shape at its upper and lower ends in such a way that the shaped portions so produced form a top panel and a lower panel, as is known in the art. A bag so constructed is to be considered as falling within the scope of the invention. In any case in the edge regions where stitching of fabric portions takes place, an isotropic sealing strip 9 constructed according to the invention is inserted and stitched in the seams 8 formed. The advantage of such a bag constructed according to FIG. 6 lies in that, apart from the very high sealing tightness obtained in the seam regions, it gives rise to lower sewing costs, because there is no longitudinal stitching on the body of the bag.

What is claimed is:

1. A bag comprising:

side and bottom panels;

a top panel provided with a filling opening;

the side and bottom panels stitched together with a stitching material to form seams;

upper edges of the sides stitched to edges of said top panel with a stitching material to form seams;

each seam having at least one upturned edge and a sealing strip inserted into each upturned edge;

said sealing strips comprising a resilient material having a substantially isotropic structure.

2. Bag according to claim 1, wherein a fabric material forming said side panels of the bag consists of a sealed, one-piece tubular portion to which said top and bottom panels are stitched.

3. Bag according to claim 1 wherein said sealing strip is made from plastic fibers and has an unwoven structure.

4. Bag according to claim 3 wherein said sealing strip has a felt-like structure.

5. Bag according to claim 3 wherein said sealing strip has a fleece-like structure.

6. Bag according to claim 1 wherein said sealing strip is many times thicker than the fabric.

7. Bag according to claim 6 wherein said sealing strip is between 4 and 10 times thicker than the fabric.

8. Bag according to claim 1 wherein said sealing strip, said fabric and threads used to stitch the seams are made of the same material.

9. Bag according to claim 8 wherein said same material is polypropylene.

10. Bag according to claim 1 wherein said seams are stitched with at least one row of stitches, and thread used to stitch said seams is impregnated with oil.

11. Bag according to claim 1 wherein said seams are stitched with two substantially parallel rows of stitches and thread used to stitch the row of stitches furthest from the bag's interior is impregnated with oil.

12. Bag according to claim 1 wherein edge regions which meet, contact each other and are turned up together to form a U-shaped seam, and said sealing strip is arranged between arms of the U-shaped seam.

* * * * *